US005542246A

United States Patent [19]

Johnson et al.

[11] Patent Number: 5,542,246

[45] Date of Patent: Aug. 6, 1996

[54] BULKHEAD COOLING FAIRING

[75] Inventors: Thomas E. Johnson, Manchester; Craig G. Thompson, South Windsor, both of Conn.

[73] Assignee: United Technologies Corporation, Hartford, Conn.

[21] Appl. No.: 356,603

[22] Filed: Dec. 15, 1994

[51] Int. Cl.[6] ..... F02C 3/14

[52] U.S. Cl. ..... 60/39.36; 60/755

[58] Field of Search ..... 60/39.36, 752, 60/755, 756, 757, 758

[56] References Cited

U.S. PATENT DOCUMENTS

| | | | |
|---|---|---|---|
| 4,302,941 | 12/1981 | DuBell | 60/755 |
| 4,773,227 | 9/1988 | Chabis | 60/757 |
| 4,949,545 | 8/1990 | Shekleton | 60/756 |
| 5,012,645 | 5/1991 | Reynolds | 60/756 |

*Primary Examiner*—Louis J. Casaregola
*Attorney, Agent, or Firm*—Edward L. Kochey, Jr.

[57] ABSTRACT

Cooling air flow from behind bulkhead liner segments 30 and from behind float wall panels 42 is guided as flow 50 over the hot surface of the bulkhead liner segments by fairing 44. The fairing is secured between a shell (38,40) and a float wall panel 42, and being of equal and coincident length as the panel, may be replaced with the removal of only one panel.

3 Claims, 2 Drawing Sheets fig. 2
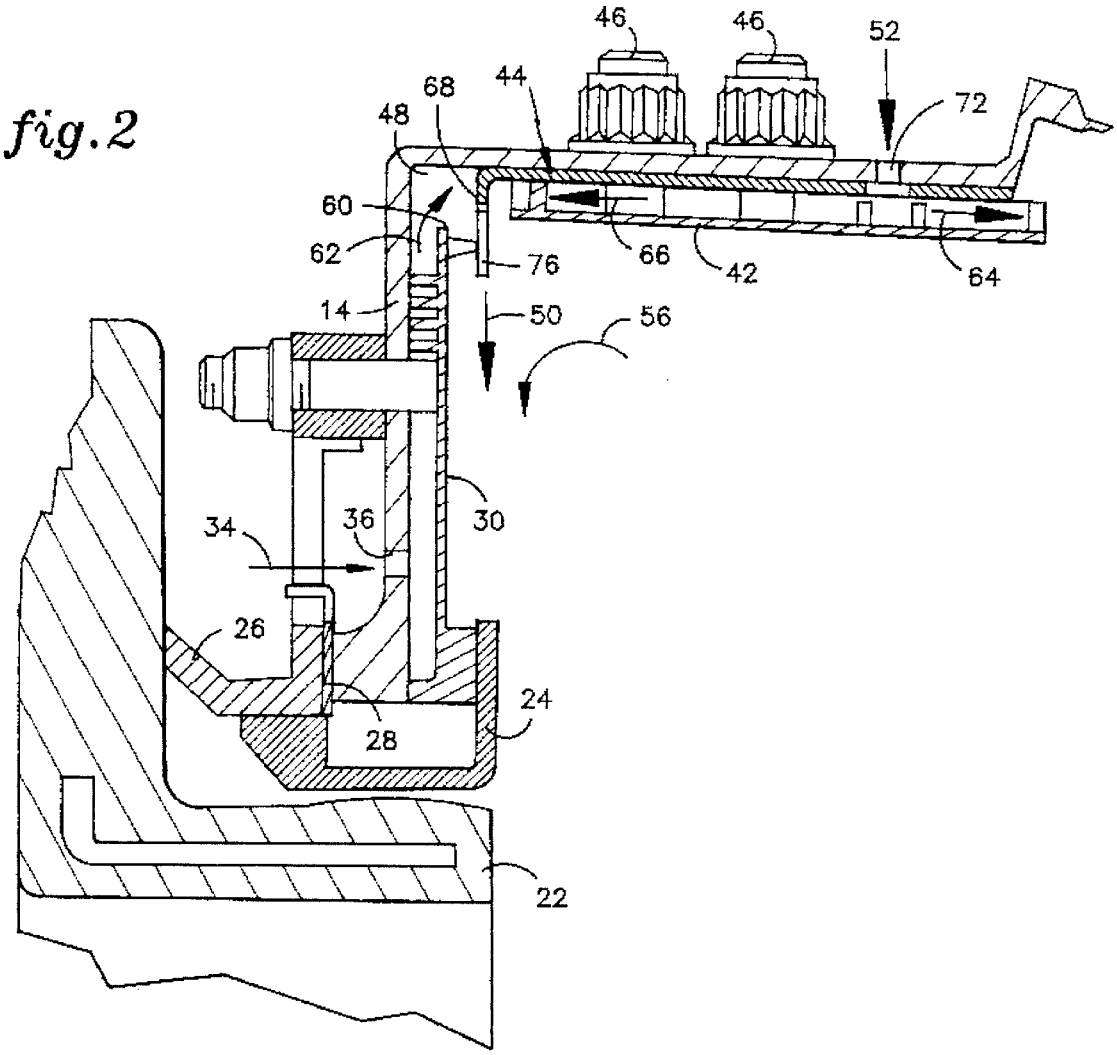
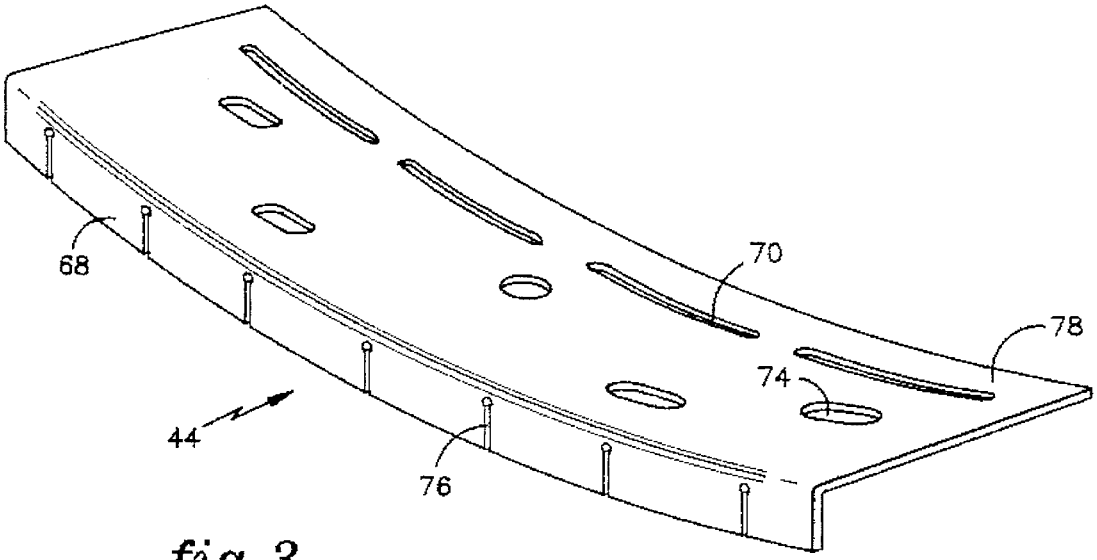
fig. 3

BULKHEAD COOLING FAIRING

TECHNICAL FIELD

The invention relates to cooling of the bulkhead liner in the combustor of a gas turbine engine and in particular in a replaceable fairing for directing the cooling air flow.

BACKGROUND OF THE INVENTION

The bulkhead of a gas turbine engine combustor must be protected from the radiant heat of the gas within the combustor. A bulkhead liner performs the function, but it must itself be cooled.

In addition to impingement cooling on the cold side conventional cooling uses inside to outside cooling flow. In other words, the cooling air flow passes radially outward, with respect to the fuel nozzle, from the fuel nozzle guide.

Where recirculating combustor flow is required passing from the combustor shell to the nozzle, the inside to outside cooling flow disrupts this recirculating flow. Therefore outside to inside flow is preferred. It also desirable to be able to easily replace any structure used to facilitate the desired cooling flow.

SUMMARY OF THE INVENTION

An annular combustor has an inner shell, an outer shell and an annular bulkhead joining the inner and outer shells at the upstream end. There are a plurality of fuel nozzle openings in the bulkhead. The inner and outer shells at the upstream end have a plurality of circumferentially arranged float wall liner panels secured to these shells. The bulkhead has a plurality of bulkhead liner sections sealed to the bulkhead at all edges except the edges adjacent the inner and outer shell.

A plurality of cooling air openings through the shells behind each of the float wall panels impinges panel cooling air against the panels, with a portion passing upstream towards the bulkhead. A plurality of cooling air openings through the bulkhead behind the bulkhead liner sections impinge cooling air against the liner section, with substantially all of this bulkhead cooling air passing radially away from the nozzle toward the shells. A fairing is located in the corner receiving the cooling from the bulkhead and the cooling air behind the float wall liner panels and is arranged to direct the cooling air radially across the bulkhead liner surface toward the nozzle. This fairing has an arcuate length substantially the same as the adjacent float wall liner panel which secures it in place. Accordingly the fairing can be replaced by removing only a single float wall liner panel.

BRIEF DESCRIPTION OF THE DRAWINGS

FIG. 2 is a sectional view showing the fairing; and

FIG. 3 is an isometric of the fairing.

DESCRIPTION OF THE PREFERRED EMBODIMENT

Figure 1:
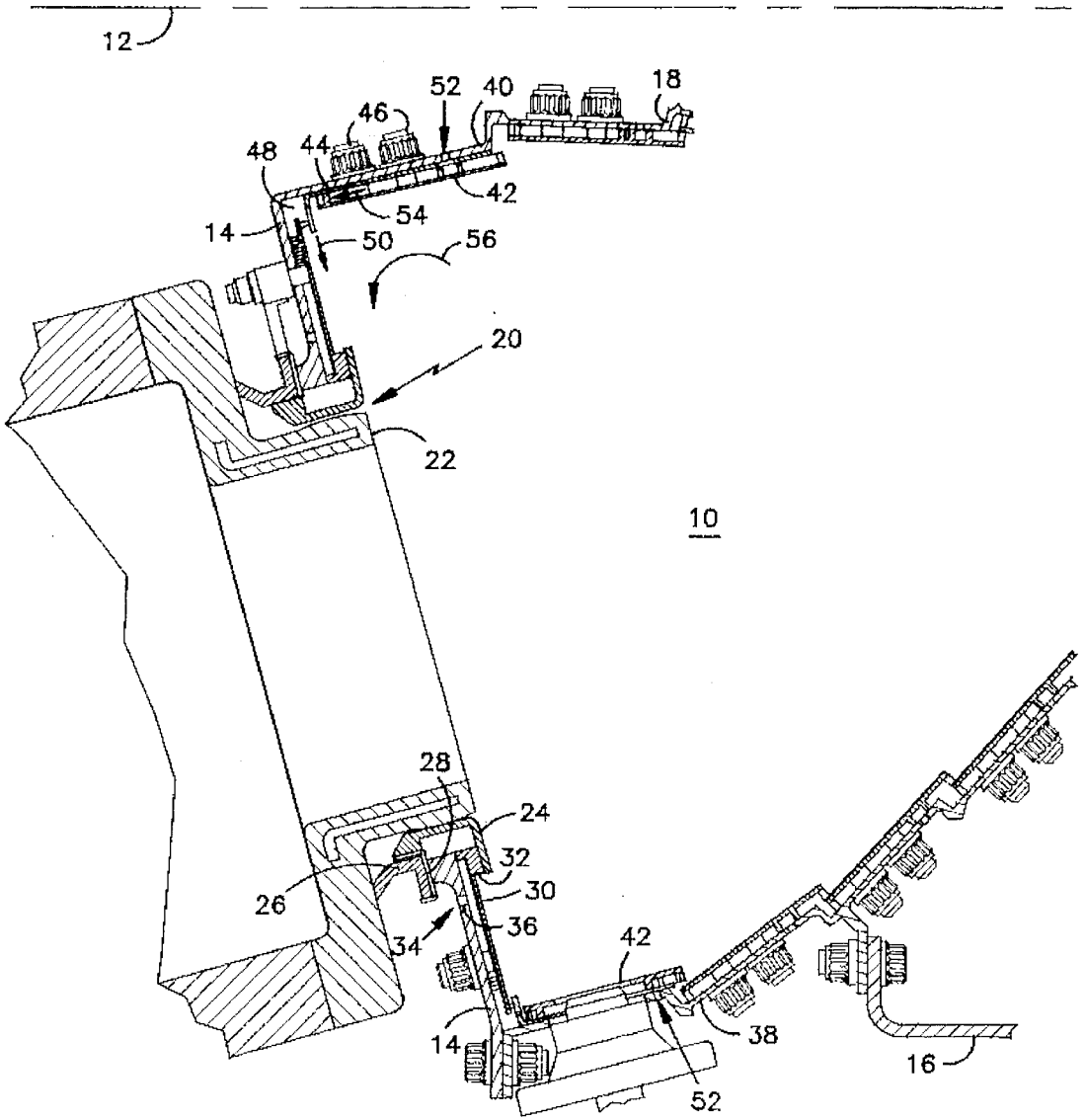
FIG. 1 is a sectional view of the annular combustor.

FIG. 1 shows an annular gas turbine combustor 10 and the centerline 12 of the gas turbine engine. The conical bulkhead 14 is supported from support structures 16 and 18. Sixteen gas turbine nozzle openings 20 are located around the circumference of the bulkhead.

A plurality of fuel nozzles 22 are locatable within these openings. These nozzles are preferably of the low $NO_x$ type with premixing of fuel and air for low temperature combustion. At each opening there is a fuel nozzle guide 24 which is axially restrained with fuel nozzle guide retainer 26. The key washer 28 prevents rotation of the fuel nozzle guide retainer 26 after installation.

The fuel nozzle guide 24 and the retainer 26 are secured to contain between them the key washer 28, the bulkhead 14 and the bulkhead liner 30. Good contact 32 is maintained between the guide and the liner segments to avoid any significant amount of air passing therethrough. Similarly good contact is maintained on both sides of the key washer 28 to prevent significant air flow past the washer.

The cooling air flow 34 passes through a plurality of openings 36 in the bulkhead impinging against the bulkhead liner 30, with the air passing behind the liner in a direction away from the location of fuel nozzle 22.

An outer shell 38 and an inner shell 40 define the boundaries of the combustor and have bolted thereto a plurality of float wall liner panels 42 at the upstream end of the combustor. A fairing 44 is entrapped between the adjacent shell and the liner panel 42. A plurality of studs and bolts 46 removably secure this structure.

The cooling air flow passing toward the shells and between the bulkhead and the bulkhead liner flows toward the corner area 48 where it turns and is guided in direction 50 along the bulkhead liner.

Cooling flow 52 passing through the inner shell and the outer shell impinges against the liner 42 with the portion of this flow passing as flow 54 toward comer 48 where fairing 44 also deflects it toward the fuel nozzle. The recirculating type flow 56 desired within the combustor is not destroyed by the direction of flow 50 which cools the bulkhead liner.

Referring to FIG. 2 the bulkhead liner segments 30 are sealed against the bulkhead 14 at all edges of each liner section except the edges 60 adjacent each of the inner and outer shells. Cooling air 34 passes through a plurality of openings 36 in the bulkhead, impinging against the cold side of the bulkhead liner sections 30. With other edges sealed, the flow passes as indicated by flow arrow 62 radially toward the shells. This flow passes around the edge of the panel and out along the surface of the liner panels as indicated by flow 50.

Cooling air 52 passes behind float wall liner panels 42 with a portion of the air 64 passing downstream and a portion of the air 66 passing upstream toward the bulkhead. Fairing 44 has a flow directing lip 68 at the upstream end for directing both the air flow 62 from the panel and the air flow 66 from the float wall liner panels across the bulkhead surface.

This lip 68 avoids the pulsations and resistance to flow which would occur between the two approaching flows in the absence of the lip. It furthermore provides means for providing a smooth transition around the bend for establishing effective smooth flow 50 across the surface.

FIG. 3 is an isometric view of the fairing 44. Opening slots 70 are aligned with the cooling flow openings 72 in the shell through which flow 52 passes. This permits the flow to pass through to cool the float wall liner panel 42. Openings 74 are aligned with stud and nut arrangements 46 to permit the studs to pass therethrough.

Lip 68 includes slots 76 to permit thermal growth of the lip without concomitant high stresses resulting in cracking.

The arcuate length of panel 44 is equal to and coincident with the arcuate length of float wall panel 42. The fairing 44 has a support length 78 which is entrapped between the shell and a float wall panel. Replacement of a fairing 44 requires only the removal of the nuts on nut and stud arrangement 46, to release the float wall panel 42 permitting the exchange of the old fairing for a new one.

The fairings are individually removable, this feature being very desirable in an industrial engine. The segmented fairings are also beneficial because of the lower replacement cost if local damage occurs.

We claim:

1. In a gas turbine engine annular combustor:

said combustor formed of an inner shell, an outer shell and an annular bulkhead joining said inner and outer shells at the upstream end;

a plurality of fuel nozzle openings in said bulkhead;

a plurality of circumferentially arranged float wall liner panels secured to said inner and outer shells at the upstream end thereof;

a plurality of cooling air openings through said shells behind each of said float wall liner panels form impinging panel cooling air against said panels and directing a portion of said panel cooling air upstream toward said bulkhead;

a plurality of bulkhead liner sections sealed to said bulkhead to all edges of each of said liner sections except the edges adjacent said inner and outer shell;

a bulkhead cooling air supply;

a plurality of cooling air openings through said bulkhead behind said bulkhead liner sections for impinging bulkhead cooling air against said liner sections and directing said bulkhead cooling air radially towards said shells; and a fairing extending radially from said shells adjacent said bulkhead liner for directing cooling air radially across said bulkhead liner surface from said bulkhead cooling air supply.

2. A gas turbine engine combustor as in claim 1, further comprising:

said fairing having a support length passing between one of said float wall panels on one of said shells, and entrapped thereinbetween.

3. A gas turbine engine combustor as in claim 2, further comprising:

said fairing having an arcuate length equal to and coincident with one of said float wall panels.

* * * * *